US006997323B2

(12) United States Patent
Maresh et al.

(10) Patent No.: US 6,997,323 B2
(45) Date of Patent: Feb. 14, 2006

(54) PACKAGING SYSTEM FOR A COMPONENT INCLUDING A COMPRESSIVE AND SHOCK-ABSORBENT PACKING INSERT

(75) Inventors: Mark Edmund Maresh, Wake Forest, NC (US); Jeffrey Jay Miller, Cary, NC (US); Eric Allen Stegner, Durham, NC (US); Robert W. Stegner, Durham, NC (US); Christopher Michael Turner, Chapel Hill, NC (US)

(73) Assignee: International Business Machines Corporation, Armonk, NY (US)

( * ) Notice: Subject to any disclaimer, the term of this patent is extended or adjusted under 35 U.S.C. 154(b) by 170 days.

(21) Appl. No.: 10/138,440

(22) Filed: May 3, 2002

(65) Prior Publication Data

US 2003/0205498 A1 Nov. 6, 2003

(51) Int. Cl.
*B65D 81/02* (2006.01)

(52) U.S. Cl. ..... 206/592; 206/590; 206/586; 206/724; 206/486; 206/784

(58) Field of Classification Search ..... 206/590–592, 206/521, 586, 588, 721–724, 784, 320, 486
See application file for complete search history.

(56) References Cited

U.S. PATENT DOCUMENTS

| | | | | |
|---|---|---|---|---|
| 1,585,684 A | | 5/1926 | Oppenheim | |
| 2,755,982 A | * | 7/1956 | Lugt, Jr. | 206/521 |
| 3,713,577 A | | 1/1973 | Skinner | 229/33 |
| 3,820,709 A | | 6/1974 | Sieffert | 229/40 |
| 3,994,399 A | * | 11/1976 | Numata et al. | 206/586 |
| 4,832,190 A | | 5/1989 | Favreau | 206/320 |
| 5,197,606 A | | 3/1993 | Lancaster | 206/594 |
| 5,341,931 A | | 8/1994 | Prochaska et al. | 206/485 |
| 5,752,605 A | * | 5/1998 | Cooper | 206/725 |
| 6,257,412 B1 | | 7/2001 | Yamamoto et al. | 206/586 |

FOREIGN PATENT DOCUMENTS

JP 05319430 A * 12/1993

* cited by examiner

*Primary Examiner*—Mickey Yu
*Assistant Examiner*—J. Gregory Pickett
(74) *Attorney, Agent, or Firm*—Sawyer Law Group LLP

(57) ABSTRACT

A packaging system for a component is disclosed. The packaging system comprises a box and a compressible and shock-absorbent packing insert. The packing insert is placed in the box after nesting a component within the insert. The insert comprises a main panel, a first end tube hingedly coupled to the main panel, a second end tube hingedly coupled to the main panel opposite the first end tube, a first side tube hingedly coupled to the main panel, the first side tube being adjacent to the first end tube and a second side tube hingedly coupled to the main panel, the second side tube being adjacent to the second end tube and opposite the first side tube wherein the first and second side tube panels and the first and second side tube panels may include at one or more cutouts to enhance the flexing capability of the packing insert. Accordingly, the packing insert in accordance with the present invention employs low cost, environment friendly material to protect fragile components from any potential damage that can be caused during the shipping process.

24 Claims, 11 Drawing Sheets

PACKAGING SYSTEM FOR A COMPONENT INCLUDING A COMPRESSIVE AND SHOCK-ABSORBENT PACKING INSERT

FIELD OF THE INVENTION

The present invention relates to tube/box inserts and more specifically to a packing insert to be used with shock-sensitive hard disk drives or similar components of varying sizes.

BACKGROUND OF THE INVENTION

Previous approaches to shipping fragile components (i.e., hard drives) have typically utilized substances such as resilient foam, as well as adhesives and other non-recyclable materials when packaging such components.

For an example of a typical packaging system, please refer now to FIG. 1. FIG. 1 is an exploded view of a typical packaging system for fragile components such as a hard drive. This approach utilizes a polyurethane bottom cushion 12, a polyurethane middle cushion 14, a polyurethane top cushion 16 and a corrugated tray 18, all of which fit into a corrugated carton 10. Utilizing this approach, the component to be shipped (not shown) is inserted between the polyurethane top cushion 16 and the polyurethane bottom cushion 12, through the polyurethane middle cushion 14. However, as previously mentioned, a drawback to this approach is the high cost of the polyurethane material, as well as the fact that polyurethane is not biodegradable and thus not environment friendly.

Accordingly, what is needed is a system and method which makes use of lower cost, environmentally safe and recyclable materials and yet safely protects fragile components from any potential damage that can be caused during the shipping process. The present invention addresses such a need.

SUMMARY OF THE INVENTION

A packaging system for a component is disclosed. The packaging system comprises a box and a compressible and shock-absorbent packing insert. The packing insert is placed in the box after nesting a component within the insert. The insert comprises a main panel, a first end tube hingedly coupled to the main panel, a second end tube hingedly coupled to the main panel opposite the first end tube, a first side tube hingedly coupled to the main panel, the first side tube being adjacent to the first end tube and a second side tube hingedly coupled to the main panel, the second side tube being adjacent to the second end tube and opposite the first side tube wherein the first and second side tube panels and the first and second side tube panels include at least one cutout to enhance the flexing capability of the packing insert.

Accordingly, the packing insert in accordance with the present invention employs low cost, environment friendly material to protect fragile components from any potential damage that can be caused during the shipping process.

DETAILED DESCRIPTION

The present invention relates to a packing insert for protecting an article. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

The preferred embodiment of the present invention is a corrugated packing insert for protecting a highly fragile component (i.e., hard disk drive) during shipment. Accordingly, the packing insert in accordance with the present invention employs a low cost, environment friendly material (i.e. corrugated material) to protect fragile components from any potential damage that can be caused during the shipping process.

Although the present invention has been described in terms of packaging a hard disk drive, one of ordinary skill in the art will readily recognize that it might also be used to package other kinds of fragile materials and components which need to be protected from any potential damage that could be caused during the shipping process.

Figure 1:
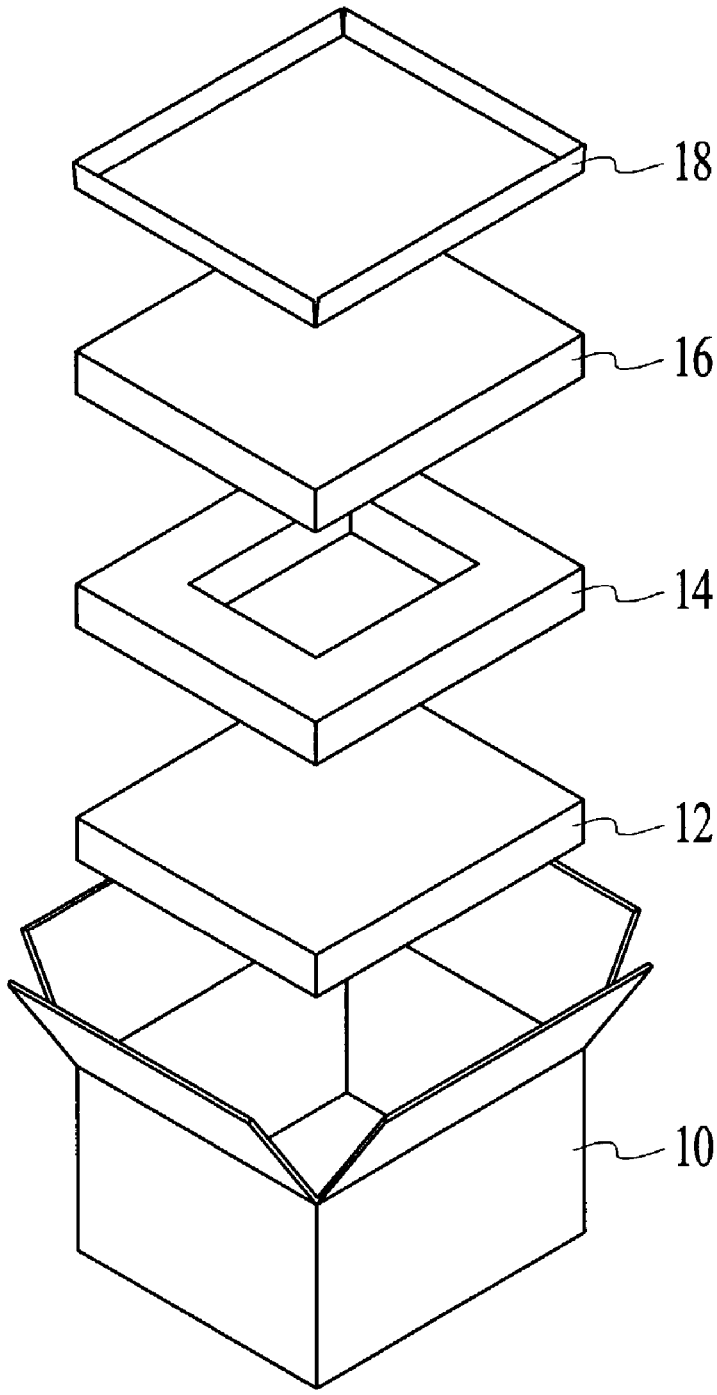
FIG. 1 (PRIOR ART)
FIG. 1 is an exploded view of a conventional packaging system for fragile components.
Figure 2:
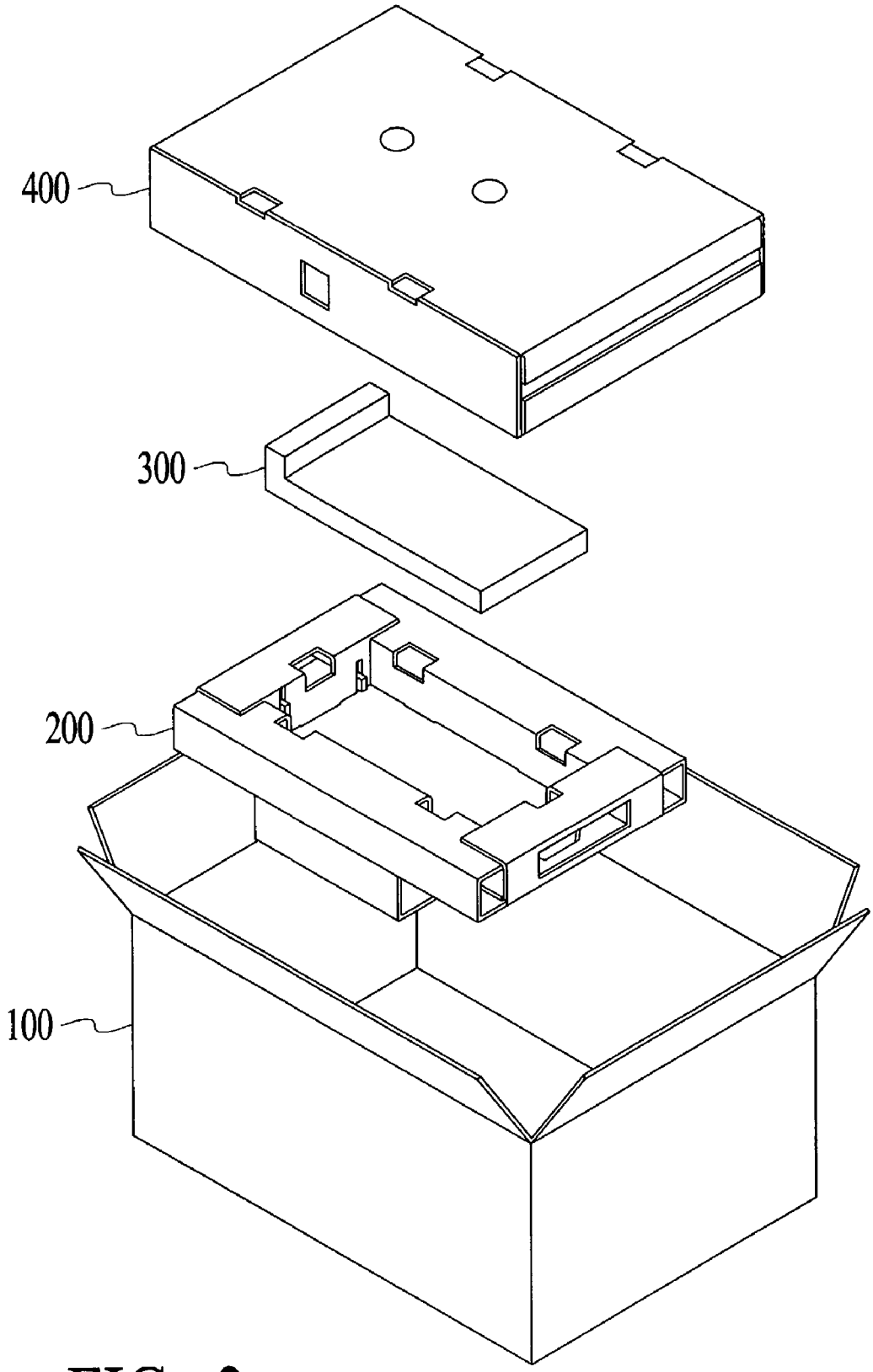
FIG. 2 is an exploded view of a packaging system in accordance with the present invention.

For a more detailed description of the present invention, refer now to the following discussion in conjunction with the accompanying figures. FIG. 2 is an exploded view of a packaging system in accordance with the present invention. The system comprises a box 100, a packing insert 200, and a top insert 400. The top insert 400 is placed above a component 300 after nesting the component 300 within the packing insert 200. The packing insert 200, the component 300, and the top insert 400 are then placed in the box 100.

Preferably, both the packing insert 200 and the top insert 400 are compressive and shock-absorbent. Specifically, the packing insert 200 and the top insert 400 are comprised of a compressive and shock-absorbent material. Further information about compressive and shock-absorbent properties in a packaging system is set forth in applicant's U.S. patent application Ser. No. 09,981,186, filed Oct. 17, 2001, and entitled PACKAGING SYSTEM FOR A COMPONENT INCLUDING A COMPRESSIVE AND SHOCK-ABSORBENT PACKING INSERT, which is assigned to the assignee of the present application and is incorporated herein by reference. In the above-identified patent application, the packaging system includes the top insert 400 whereby the top insert 400 is preferably made of a corrugated paper material due to the compressive properties of the material.

In a system and method in accordance with the present application, the packing insert 200 is also preferably made of a corrugated paper material. Again, the corrugated paper material is preferable due to the compressive properties of the material. Specifically, the corrugated paper material has a tendency to flex when it is compressed during shock and vibration and therefore functions in a manner similar to that of a plastic foam typically utilized in conventional packaging systems. The corrugated paper material is considerably less expensive than the plastic foam and is also biodegradable and thus environment friendly.

Accordingly, the packing insert 200 is preferably utilized in conjunction with the top insert 400 to further enhance the compressive and shock-absorbent properties of the packaging system. Additionally, since the corrugated paper material is considerably less expensive than the plastic foam, the cost of the packaging system in accordance with the present invention is substantially lower than the cost of conventional packaging systems.

Although the present invention has been described in terms of being made of a corrugated material, one of ordinary skill in the art will readily recognize that the present invention could be made with any of a variety of low cost, environmentally friendly materials while remaining within the spirit and scope of the present invention.

Figure 3:
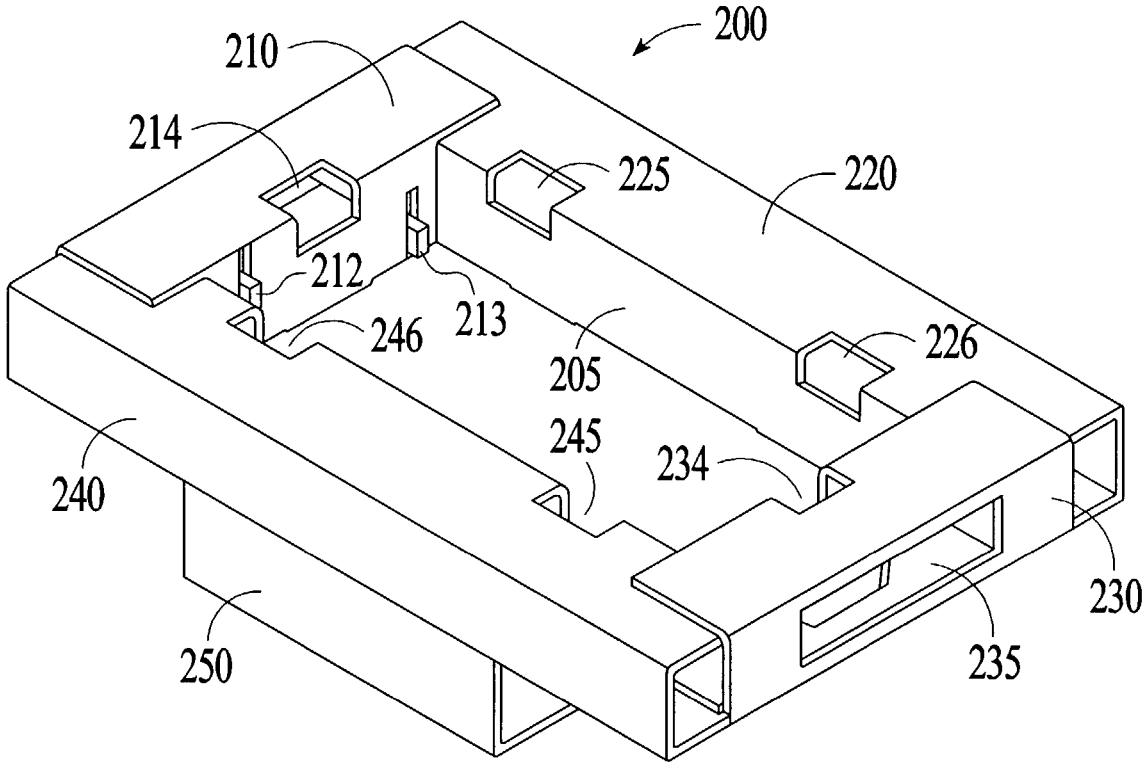
FIG. 3 shows the assembled packing insert in accordance with the present invention.

For a clearer perspective of the present invention, please refer now to FIG. 3. FIG. 3 shows an assembled packing insert 200 in accordance with the present invention. Shown are a main panel 205, first and second end tubes 210, 230, first and second side tubes 220, 240 and a first bottom tube 250. (A second bottom tube 260 opposite the first bottom tube 250 is not shown.)

The first end tube 210 includes two slots 212, 213 and a cutout 214. The first side tube 220 includes two cutouts 225, 226. The second end tube 230 includes cutout 234 and an opening 235. The second side tube 240 includes two cutouts 245, 246.

In designing the packing insert 200, much consideration is given to the placement of the various cutouts/slots/openings that are present in the preferred embodiment of the packing insert 200. The placement of cutouts/slots/openings in the corrugated material help enhance the flexing capability of the insert 200. Accordingly, the more cutouts/slots/openings that are present on the insert 200, the more flexible the insert 200 becomes. However, the less cutouts/slots/openings that are present on the insert 200, the less flexible (more rigid) the insert 200 becomes. Correspondingly, the above-described placement of the cutouts/slots/openings on the packing insert 200 in accordance with the present invention, represents a preferred configuration whereby a desired balance between flexibility and rigidity is achieved.

Although the present invention has been described in terms of specific placements of cutouts/slots/openings in the packing insert, one of ordinary skill in the art will readily recognize that the cutouts/slots/openings can be configured in a variety of different ways while remaining within the spirit and scope of the present invention.

Figure 4:
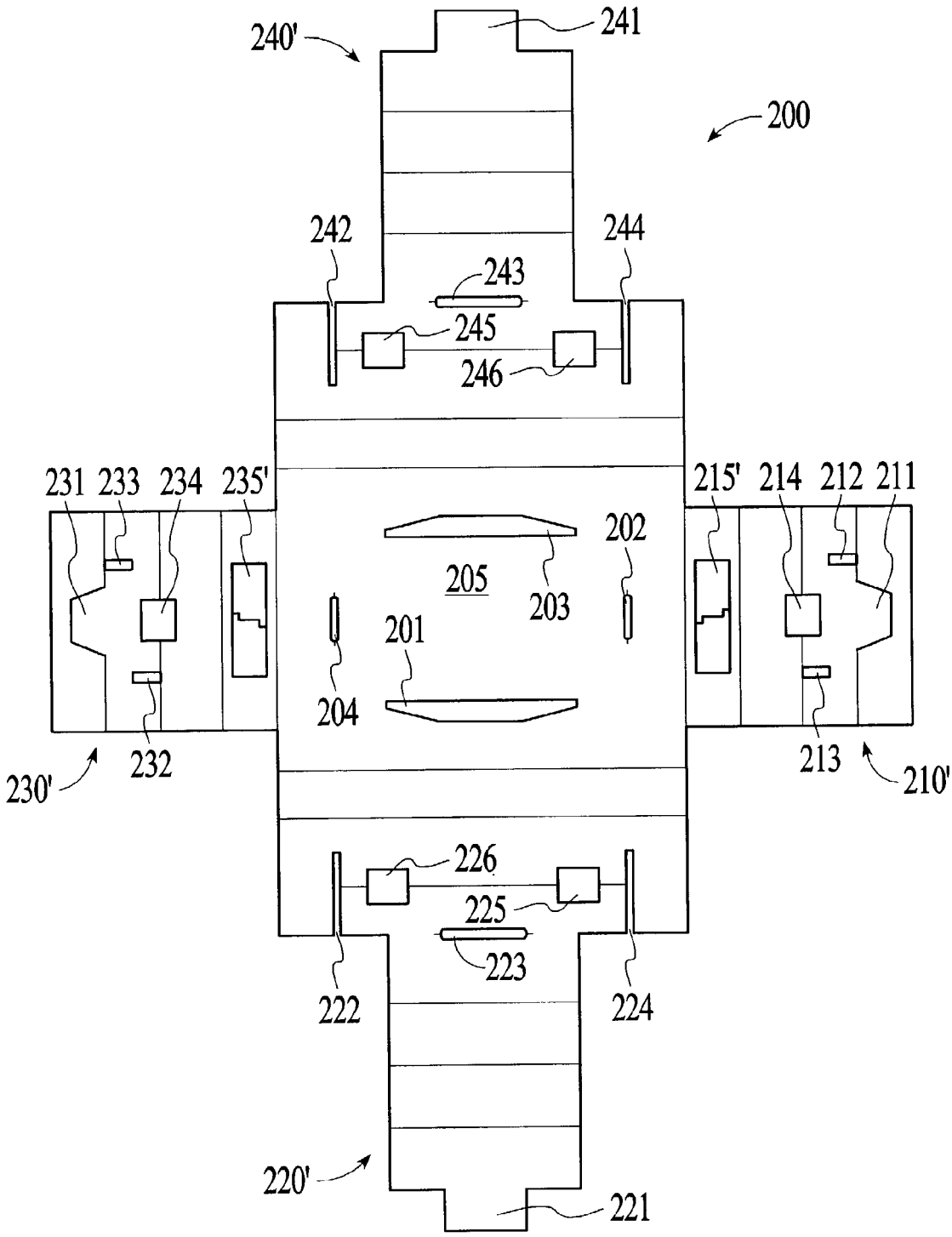
FIG. 4 is an illustration of the packing insert in accordance with the present invention in an unassembled configuration.

For a detailed understanding of the packing insert in accordance with the present invention, please refer now to FIG. 4. FIG. 4 is an illustration of the packing insert 200 in accordance with the present invention in an unassembled configuration. The insert 200 comprises the main panel 205 wherein the main panel 205 includes first and second apertures 201, 203, the first and second apertures 201, 203 being located on opposite sides of the main panel 205. The main panel 205 further comprises first and second slots 202, 204, the first and second slots 202, 204 being located on opposite sides of the main panel 205.

The insert 200 further comprises a first and second plurality of end tube panels 210', 230' and a first and second plurality of side tube panels 220', 240' wherein the first and second plurality of end tube panels 210', 230' and the first and second plurality of side tube panels 220', 240' are hingedly coupled to main panel 205. The first and second plurality of end tube panels 210', 230' are respectively utilized to form the first and second end tube panels 210, 230 (see FIG. 3) and the first and second plurality of side tube panels 220', 240' are respectively utilized to form the first and second side tube panels 220, 240 (see FIG. 3).

The first plurality of end tube panels 210' is adjacent to the first plurality of side tube panels 220'. The second plurality of end tube panels 230' is adjacent to the first plurality of side tube panels 220' and opposite the first plurality of end tube panels 230'. The second plurality of side tube panels 240' is adjacent to the second plurality of end tube panels 230' and opposite the first plurality of side tube panels 220'.

The first plurality of end tube panels 210' includes a tab 211, two slots 212, 213, a cutout 214 and a push-in tab 215'. Similarly, the second plurality of end tube panels 230' includes a tab 231, two slots 232, 233, a cutout 234 and a push-in tab 235'. The first plurality of side tube panels 220' includes a tab 221, three slots 222, 223, 224, and two cutouts 225, 226. Likewise, the second plurality of side tube panels 240' includes a tab 241, three slots 242, 243, 244, and two cutouts 245, 246.

Again, it should be noted that the placement of the cutouts/slots/openings on the packing insert 200 in accordance with the present invention, represents a preferred configuration whereby a desired balance between flexibility and rigidity is achieved.

For an illustration of how to assemble the packing insert 200 in accordance with the present invention, please refer now to FIGS. 5–11. To start, the first plurality of side tube panels 220' are foldably inserted into the first aperture 201 via the tab 221 thereby forming a first side tube. Next, the second plurality of side tube panels 240' are foldably inserted into the second aperture 203 via the tab 241 thereby forming a second side tube.

Figure 5:
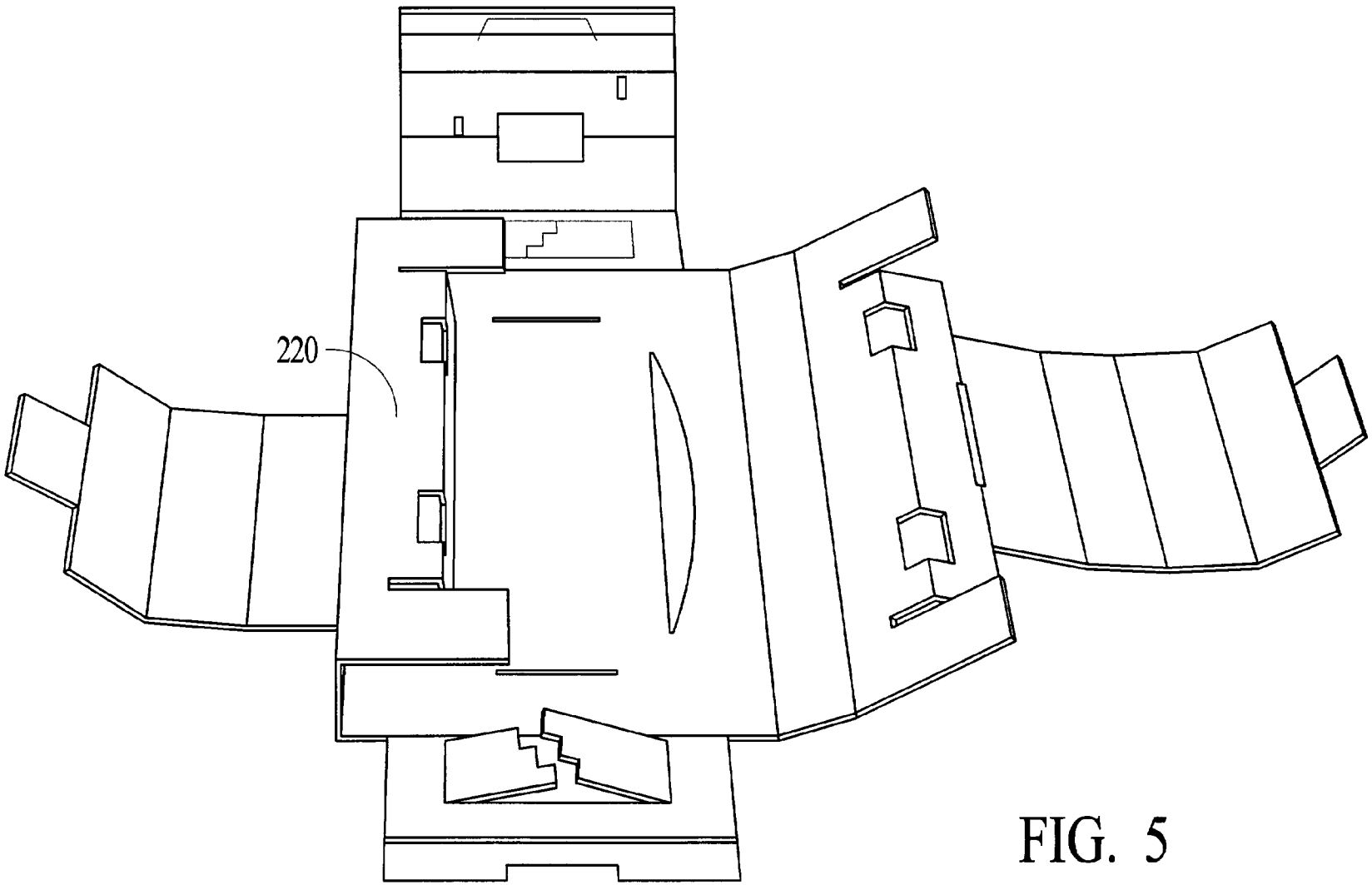
FIG. 5 shows the formation of a first side tube.
Figure 6:
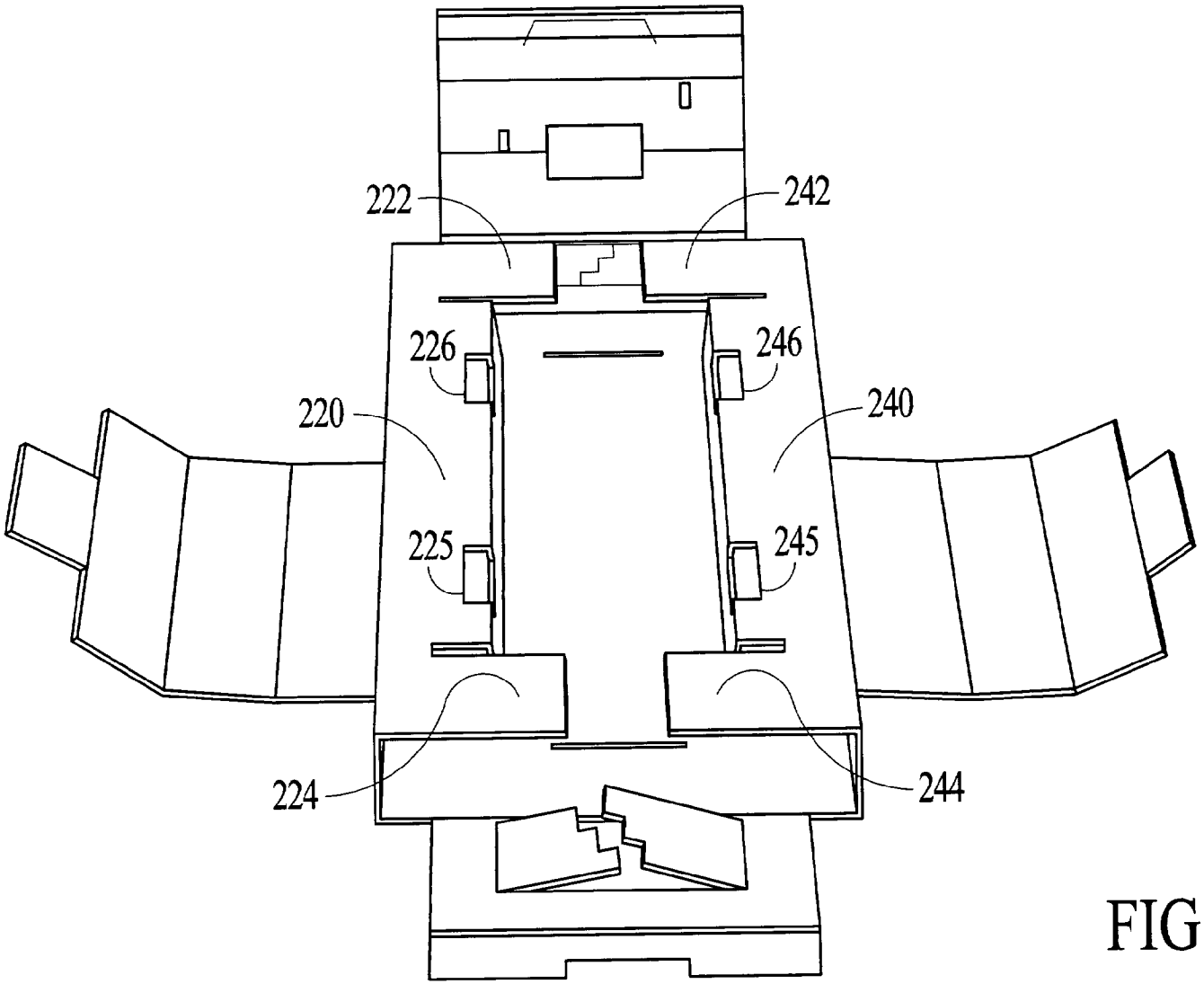
FIG. 6 shows the formation of the second side tube.

For a further understanding, please refer now to FIGS. 5 and 6. FIG. 5 shows the formation of a first side tube 220. FIG. 6 shows the formation of the second side tube 240. Also shown in FIG. 5 are slots 222, 224 and cutouts 225, 226 in the first side tube 220 and slots 242, 244 and cutouts 245, 246 in the second side tube 240.

Next, the tab 211 of first plurality of end tube panels 210' is foldably inserted into the first slot 202 of the main panel 205 via slots 224 and 244 of the first and second side tubes thereby forming a first end tube. Next, the tab 231 of the second plurality of end tube panels 230' is foldably inserted into the second slot 204 of the main panel 205 via slots 222 and 242 of the first and second side tubes thereby forming a second end tube. Once the first and second end tubes are formed, push-in tabs 215' and 235' are pushed in to create respective openings in the first and second end tubes.

Figure 7:
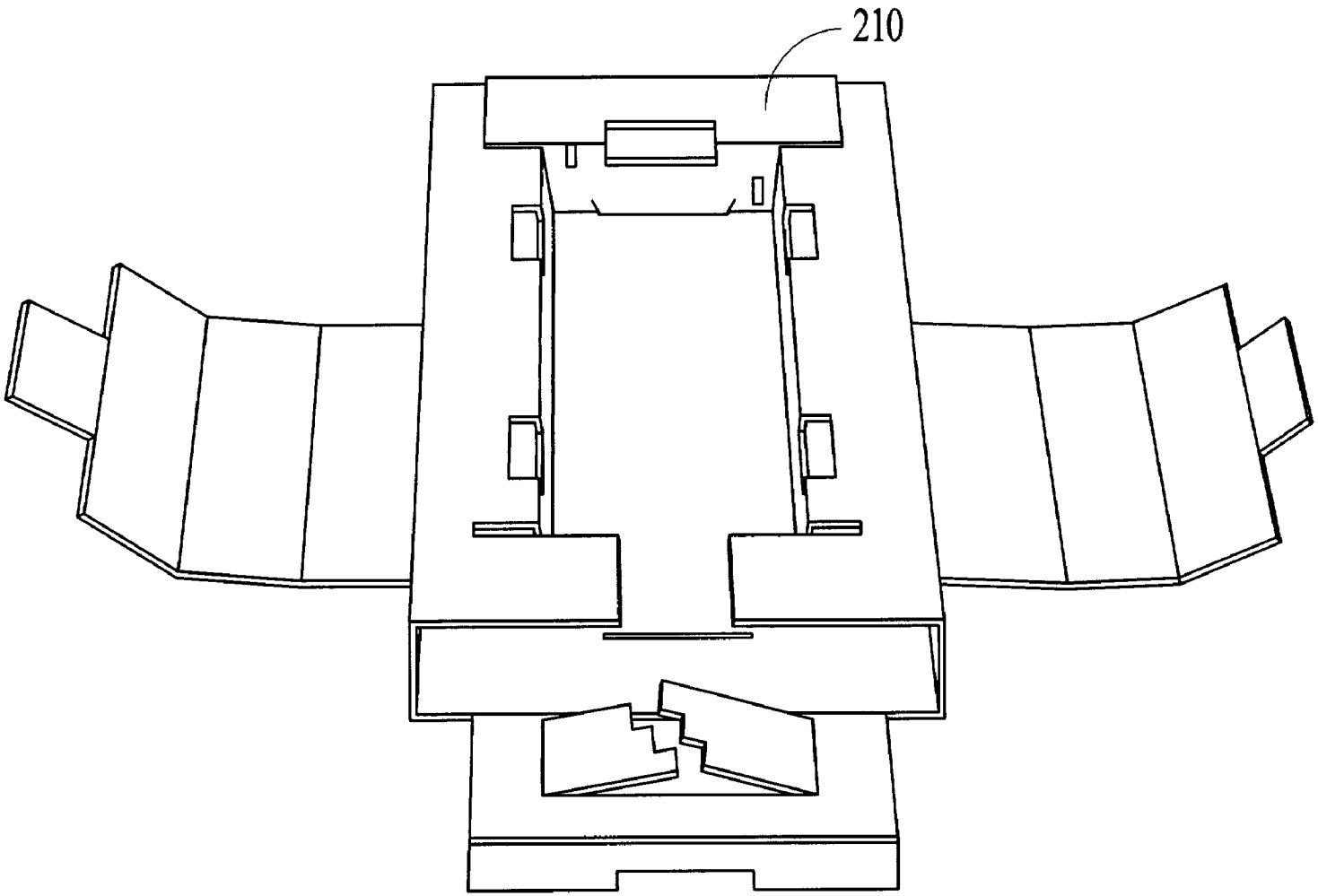
FIG. 7 shows the formation of a first end tube.
Figure 8:
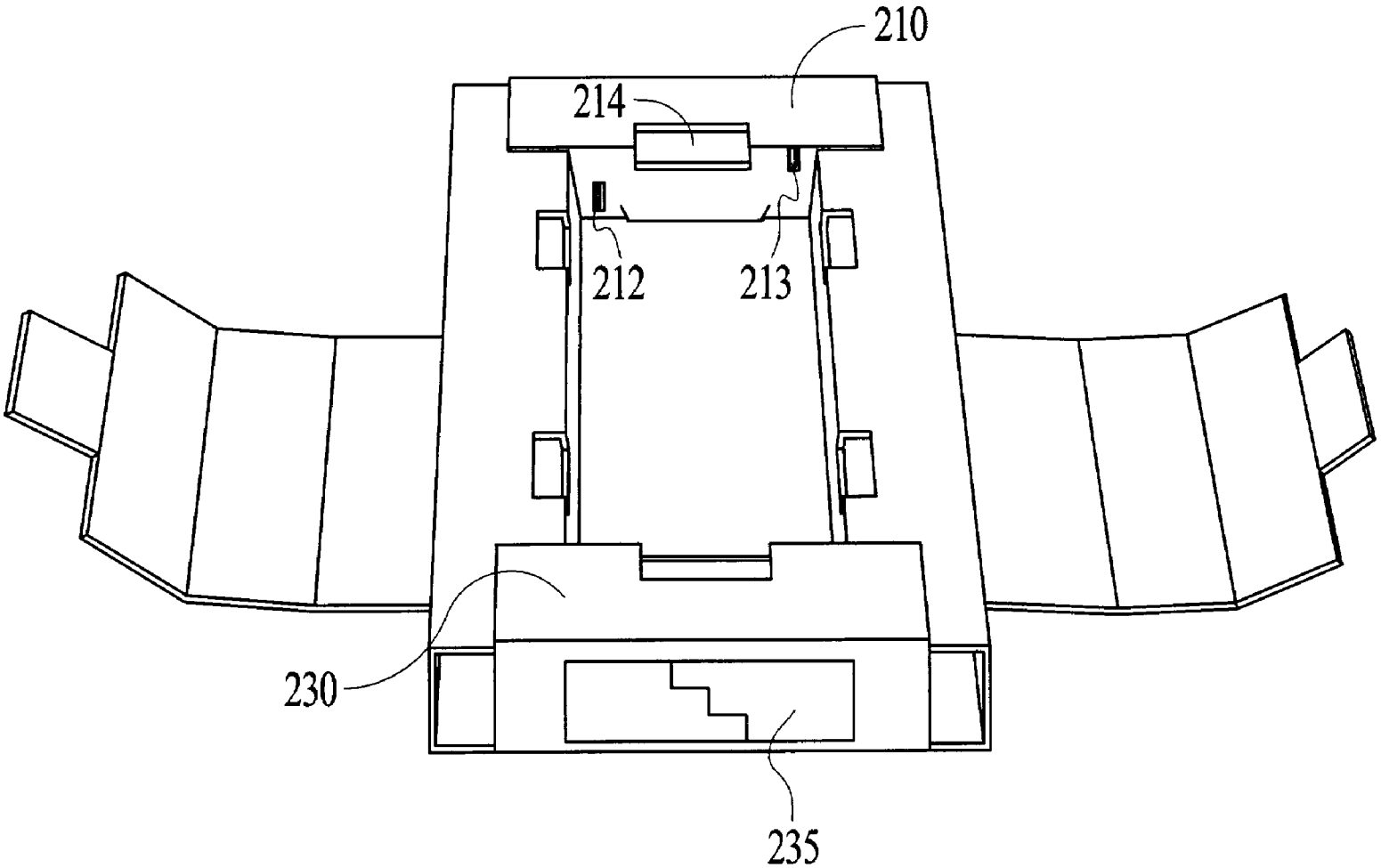
FIG. 8 shows the formation of a second end tube.
Figure 9:
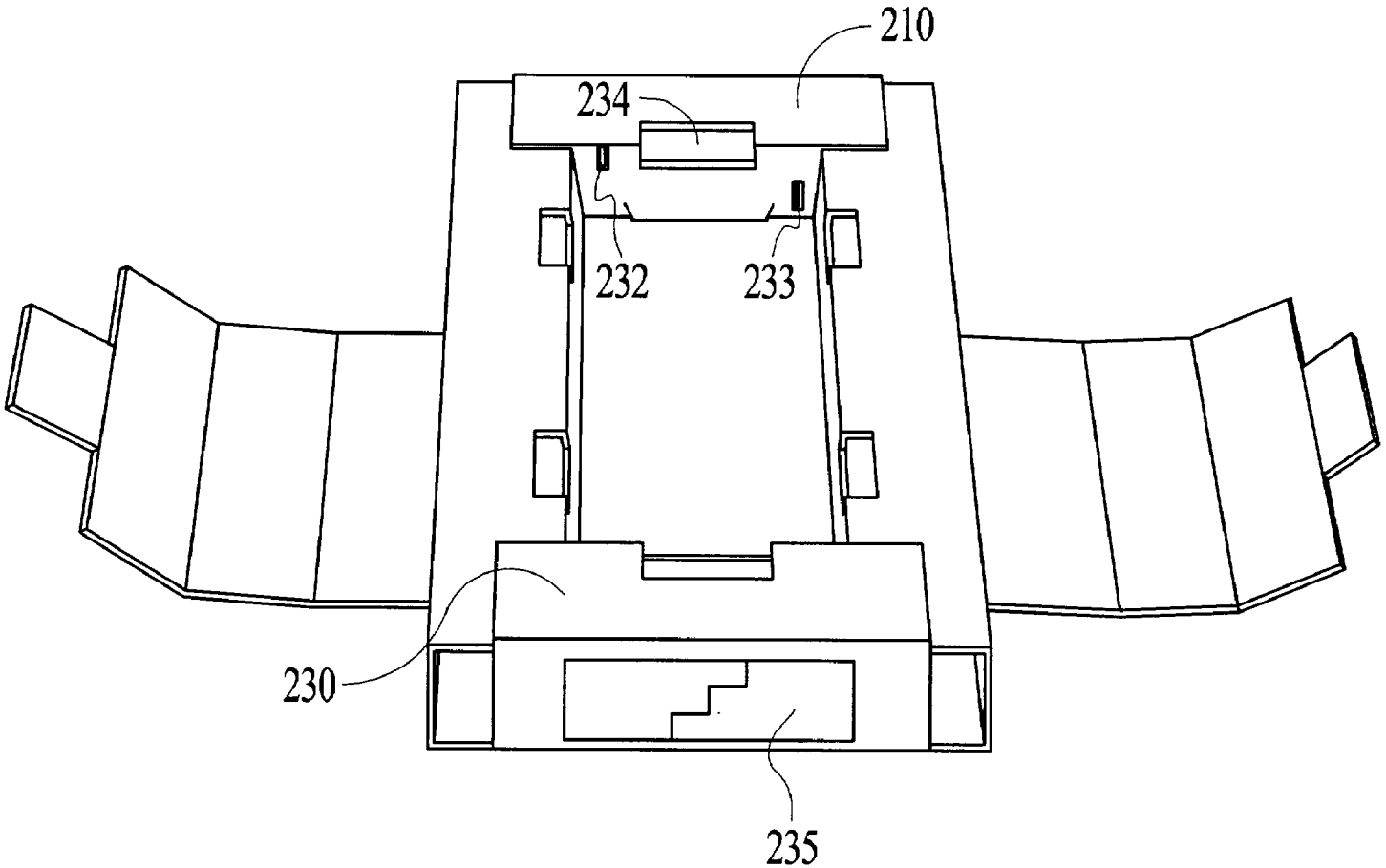
FIG. 9 shows the reverse angle of FIG. 8.

For a further illustration, please refer now to FIGS. 7–9. FIG. 7 shows the formation of a first end tube 210 and FIG. 8 shows the formation of the second end tube 230. Also shown in FIG. 8 are slots 212, 213 and cutout 214 in the first end tube 210 as well as an opening 235 in the second end tube 230, said opening 235 having been created via push-in tabs 235'. FIG. 9 is the reverse angle of FIG. 8 and shows slots 232, 233 and cutout 234 in the second end tube 230' as well as an opening 215 in the first end tube 210, said opening 215 having been created via push-in tabs 215'.

Another feature associated with the present invention are bottom tubes located underneath the main panel 205. These are formed utilizing the side tube panels. Accordingly, once the first plurality of side tube panels 220' are inserted into the first aperture 201, the tab 221 is inserted into the slot 223 whereby the tab 221 is locked underneath the main panel 205 thereby forming a first bottom tube. Similarly, tab 241 of the second plurality of side tube panels 240' is inserted into the slot 243 whereby the tab 241 is locked underneath the main panel 205 thereby forming a second bottom tube.

Figure 10:
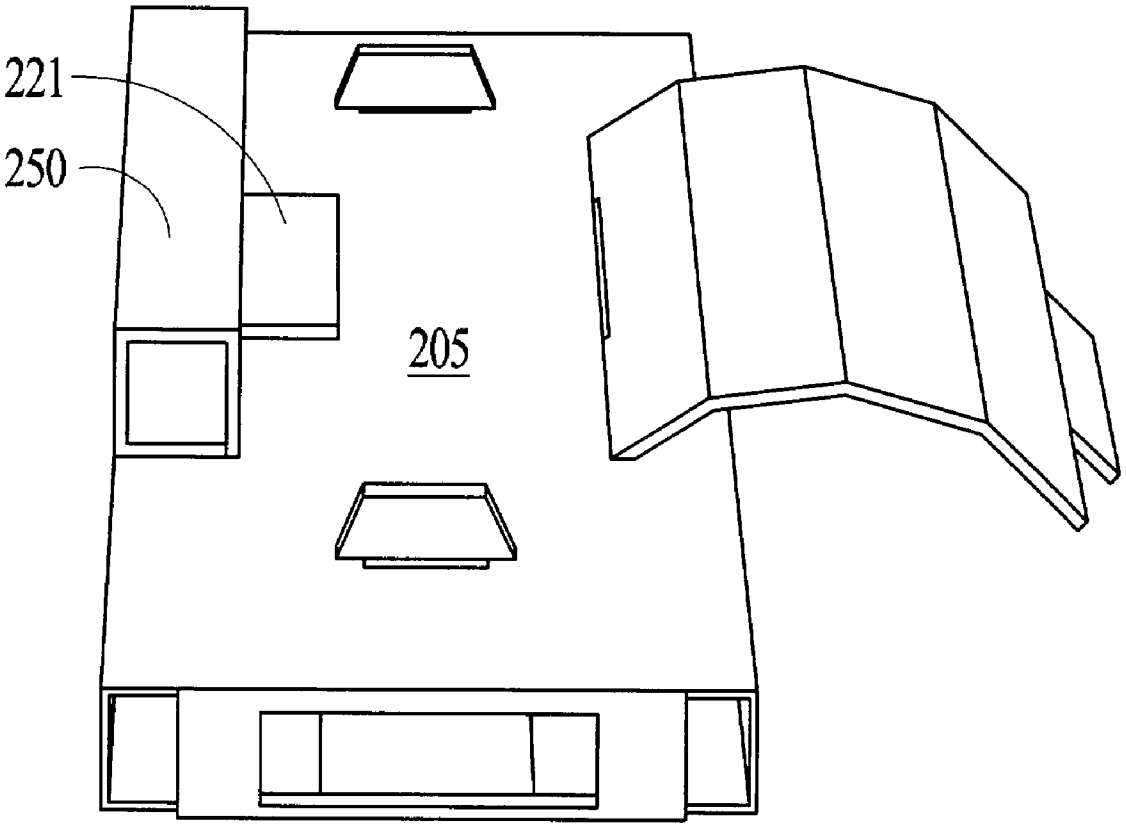
FIG. 10 shows the formation of a first bottom tube.
Figure 11:
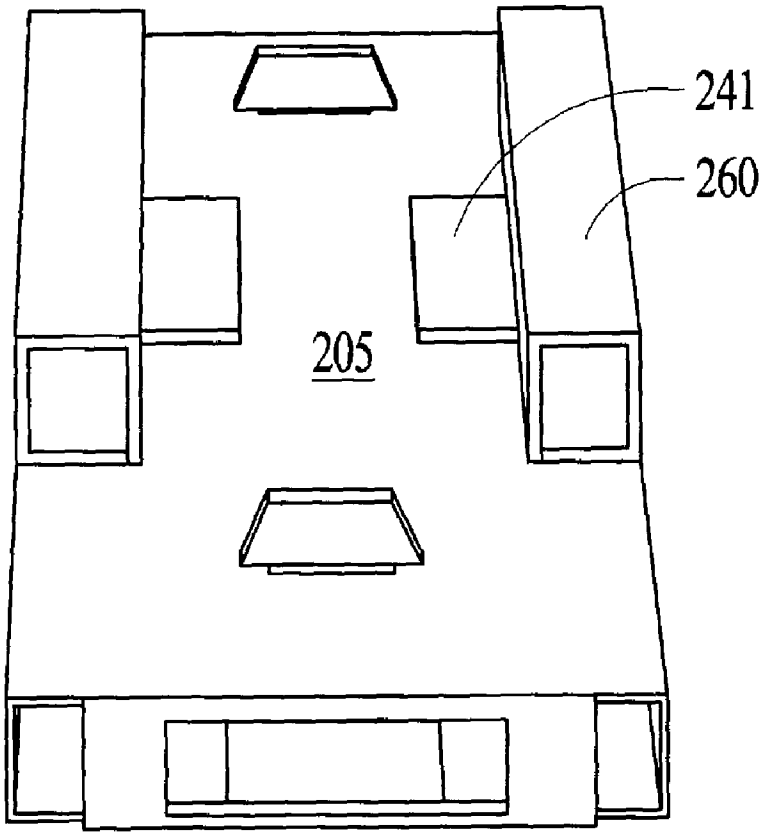
FIG. 11 shows the formation of a second bottom tube.

For a further understanding, please refer to FIGS. 10 and 11. FIG. 10 is a bottom view of the insert and shows the formation of a first bottom tube 250 whereby tab 221 is locked underneath the main panel 205. FIG. 11 is also a bottom view of the insert and shows the formation of a second bottom tube 260 whereby tab 241 is locked underneath the main panel 205.

The present invention is a corrugated packing insert for protecting an article of manufacture (i.e. hard disk drive) during shipment. Accordingly, the packing insert in accordance with the present invention employs a low cost, environment friendly material (i.e. corrugated material) to protect fragile components from any potential damage that can be caused during the shipping process.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A packaging system for a component, the packaging system comprising:

a box; and a compressible and shock-absorbent packing insert, wherein the packing insert is placed in the box after nesting a component within the insert, the packing insert comprising:

a main panel;

a first end tube hingedly coupled to the main panel;

a second end tube hingedly coupled to the main panel opposite the first end tube;

a first side tube hingedly coupled to the main panel, the first side tube being adjacent to the first end tube;

a second side tube hingedly coupled to the main panel, the second side tube being adjacent to the second end tube and opposite the first side tube wherein the first and second side tubes and the first and second end tubes comprise at least one cutout over an edge of at least one of the tubes to enhance the flexing capability of the packing insert;

a first bottom tube coupled to the first side tube, wherein the first bottom tube is formed by being inserted through a first slot in the main panel; and a second bottom tube coupled to the second side tube, wherein the second bottom tube is formed by being inserted through a second slot in the main panel.

2. The packaging system of claim 1 wherein the packing insert comprises a corrugated paper material that is biodegradable.

3. The packaging system of claim 2 wherein the first and second end tubes each comprise a plurality of end tube panels wherein at least one of the plurality of end tube panels includes a tab and a cutout.

4. The packaging system of claim 3 wherein the first and second side tubes each comprise a plurality of side tube panels wherein at least one of the plurality of side tube panels includes a tab, at least one cutout, and a first, second and third slot.

5. The packaging system of claim 4 wherein the main panel includes first and second apertures, the first and second apertures being located on opposite sides of the main panel.

6. The packaging system of claim 5 wherein the first side tube comprises first and second tube slots and at least one cutout and the second side tube comprises first and second tube slots and at least one cutout.

7. The packaging system of claim 6 wherein the insert further comprises:

the first bottom tube located underneath the main panel; and the second bottom tube located underneath the main panel opposite the first bottom tube.

8. The packaging system of claim 7 wherein the main panel further includes first and second slots, the first and second slots being located on opposite sides of the main panel.

9. A packing insert for protecting an article comprising:

a main panel;

a first end tube hingedly coupled to the main panel;

a second end tube hingedly coupled to the main panel opposite the first end tube;

a first side tube hingedly coupled to the main panel, the first side tube being adjacent to the first end tube;

a second side tube hingedly coupled to the main panel, the second side tube being adjacent to the second end tube and opposite the first side tube wherein the first and second side tubes and the first and second end tubes comprise at least one cutout over an edge of at least one of the tubes to enhance the flexing capability of the packing insert;

a first bottom tube coupled to the first side tube, wherein the first bottom tube is formed by being inserted through a first slot in the main panel; and a second bottom tube coupled to the second side tube, wherein the second bottom tube is formed by being inserted through a second slot in the main panel.

10. The packing insert of claim 9 wherein the packing insert comprises a corrugated paper material that is biodegradable.

11. The packing insert of claim 10 wherein the first and second end tubes each comprise a plurality of end tube panels wherein at least one of the plurality of end tube panels includes a tab and a cutout.

12. The packing insert of claim 11 wherein the first and second side tubes each comprise a plurality of side tube panels wherein at least one of the plurality of side tube panels includes a tab, at least one cutout, and a first, second and third slot.

13. The packing insert of claim 12 wherein the main panel includes first and second apertures, the first and second apertures being located on opposite sides of the main panel.

14. The packing insert of claim 13 wherein the first side tube comprises first and second tube slots and at least one cutout and the second side tube comprises first and second tube slots and at least one cutout.

15. The packing insert of claim 14 wherein the insert further comprises:

the first bottom tube located underneath the main panel; and the second bottom tube located underneath the main panel opposite the first bottom tube.

16. The packing insert of claim 15 wherein the main panel further includes first and second slots, the first and second slots being located on opposite sides of the main panel.

17. The packing insert of claim 16 wherein the first end tube comprises the cutout of the first plurality of end tube panels and the second end tube comprises the cutout of the second plurality of end tube panels.

18. A packing insert for protecting an article comprising:

a main panel, the main panel including first and second apertures, the first and second apertures being located on opposite sides of the main panel and first and second slots, the first and second slots being located on opposite sides of the main panel;

a first end tube, the first end tube comprising a first plurality of end tube panels hingedly coupled to the main panel;

a second end tube, the second end tube comprising a second plurality of end tube panels hingedly coupled to the main panel opposite the second end tube;

a first side tube, the first side tube comprising a first plurality of side tube panels hingedly coupled to the main panel, the first side tube being adjacent to the first end tube;

a second side tube, the second side tube comprising a second plurality of side tube panels hingedly coupled to the main panel opposite the first side tube, the second side tube being adjacent to the second end tube wherein the first and second side tubes and the first and second end tubes comprise at least one cutout over an edge of at least one of the tubes for enhancing the flexing capability of the packing insert;

a first bottom tube coupled to the first side tube, wherein the first bottom tube is formed by being inserted through a first slot in the main panel; and a second bottom tube coupled to the second side tube, wherein the second bottom tube is formed by being inserted through a second slot in the main panel.

19. The packing insert of claim 18 wherein the packing insert further comprises:

the first bottom tube located underneath the main panel; and the second bottom tube located underneath the main panel opposite the first bottom tube.

20. The packing insert of claim 18 wherein the packing insert comprises a corrugated paper material that is biodegradable.

21. A packing insert for protecting an article comprising:

a main panel, the main panel including first and second apertures, the first and second apertures being located on opposite sides of the main panel and first and second slots, the first and second slots being located on opposite sides of the main panel;

a first end tube, the first end tube comprising a first plurality of end tube panels hingedly coupled to the main panel;

a second end tube, the second end tube comprising a second plurality of end tube panels hingedly coupled to the main panel opposite the second end tube;

a first side tube, the first side tube comprising a first plurality of side tube panels hingedly coupled to the main panel, the first side tube being adjacent to the first end tube;

a second side tube, the second side tube comprising a second plurality of side tube panels hingedly coupled to the main panel opposite the first side tube, the second side tube being adjacent to the second end tube wherein the first and second side tubes and the first and second end tubes comprise at least one cutout over an edge of at least one of the tubes for enhancing the flexing capability of the packing insert;

a first bottom tube coupled to the first side tube, wherein the first bottom tube is formed by being inserted through a first slot in the main panel; and a second bottom tube coupled to the second side tube, wherein the second bottom tube is formed by being inserted through a second slot in the main panel.

22. A corrugated packing insert for protecting an article comprising:

a main panel, the main panel including first and second apertures, the first and second apertures being located on opposite sides of the main panel and first and second slots, the first and second slots being located on opposite sides of the main panel;

a first end tube, the first end tube comprising a first plurality of end tube panels hingedly coupled to the main panel;

a second end tube, the second end tube comprising a second plurality of end tube panels hingedly coupled to the main panel opposite the second end tube;

a first side tube, the first side tube comprising a first plurality of side tube panels hingedly coupled to the main panel, the first side tube being adjacent to the first end tube;

a second side tube, the second side tube comprising a second plurality of side tube panels hingedly coupled to the main panel opposite the first side tube, the second side tube being adjacent to the second end tube wherein the first and second side tubes and the first and second end tubes comprise at least one cutout over an edge of at least one of the tubes for enhancing the flexing capability of the packing insert;

a first bottom tube coupled to the first side tube, wherein the first bottom tube is formed by being inserted through a first slot in the main panel; and a second bottom tube coupled to the second side tube, wherein the second bottom tube is formed by being inserted through a second slot in the main panel.

23. A packaging system for a component, the packaging system comprising:

a box;

a compressible and shock-absorbent packing insert; and a compressible and shock-absorbent top insert, wherein the top insert is placed above a component after nesting the component within the compressible and shock-absorbent packing insert, wherein the packing insert comprises:

a main panel;

a first end tube hingedly coupled to the main panel;

a second end tube hingedly coupled to the main panel opposite the first end tube;

a first side tube hingedly coupled to the main panel, the first side tube being adjacent to the first end tube;

a second side tube hingedly coupled to the main panel, the second side tube being adjacent to the second end tube and opposite the first side tube wherein the first and second side tubes and the first and second end tubes comprise at least one cutout over an edge of at least one of the tubes to enhance the flexing capability of the packing insert a first bottom tube coupled to the first side tube, wherein the first bottom tube is formed by being inserted through a first slot in the main panel; and a second bottom tube coupled to the second side tube, wherein the second bottom tube is formed by being inserted through a second slot in the main panel.

24. The packing system of claim 23 wherein the packing insert and the top insert are comprised of a corrugated paper material that is biodegradable.

* * * * *